United States Patent [19]

Gardner et al.

[11] Patent Number: 5,010,333

[45] Date of Patent: Apr. 23, 1991

[54] ADVANCED DIGITAL TELEMETRY SYSTEM FOR MONOCABLE TRANSMISSION FEATURING MULTILEVEL CORRELATIVE CODING AND ADAPTIVE TRANSVERSAL FILTER EQUALIZER

[75] Inventors: Wallace R. Gardner, Houston; Kenneth R. Goodman; Robert D. Puckett, both of LaPorte; Ricky L. Draehn, Houston, all of Tex.

[73] Assignee: Halliburton Logging Services, Inc., Houston, Tex.

[21] Appl. No.: 353,278

[22] Filed: May 17, 1989

[51] Int. Cl.[5] ..... G01V 1/00

[52] U.S. Cl. ..... 340/856; 340/858

[58] Field of Search ..... 364/422; 340/853, 856–859; 367/78, 81

[56] References Cited

U.S. PATENT DOCUMENTS

| | | | |
|---|---|---|---|
| 3,991,611 | 11/1976 | Marshal III et al. | 340/857 |
| 4,797,668 | 1/1989 | Zimmer | 340/857 |
| 4,808,996 | 2/1989 | Zimmer | 340/858 |

*Primary Examiner*—Brian S. Steinberger

*Attorney, Agent, or Firm*—William J. Beard

[57] ABSTRACT

The present disclosure is directed to an improved telemetry system and data recovery telemetry receiver apparatus for installation with a logging cable supported sonde. In the sonde, a data stream is modulated onto a carrier after conversion by an encoder. Encoding involves conversion from a stream of binary data into four state symbols which are then encoded into seven duobinary levels. The availability of redundant levels permits correlation between encoded symbols and adjacent symbols. This is transmitted up the monocable to the surface and is recovered. The recovery involves amplification by an automatic gain control amplifier, conversion from an analog to digital form in an ADC, demodulation and reconstruction of the transmitted signal by means of a adaptive transversal filter equalizer featuring fractionally spaced sampling. Reconstructed output levels are then provided, and a slicer adjusts those values to the permitted seven levels. The data is then decoded. Extraordinary bandwidth compression is accomplished so that a large data flow can be provided through a monocable having only limited band pass capacity.

24 Claims, 8 Drawing Sheets

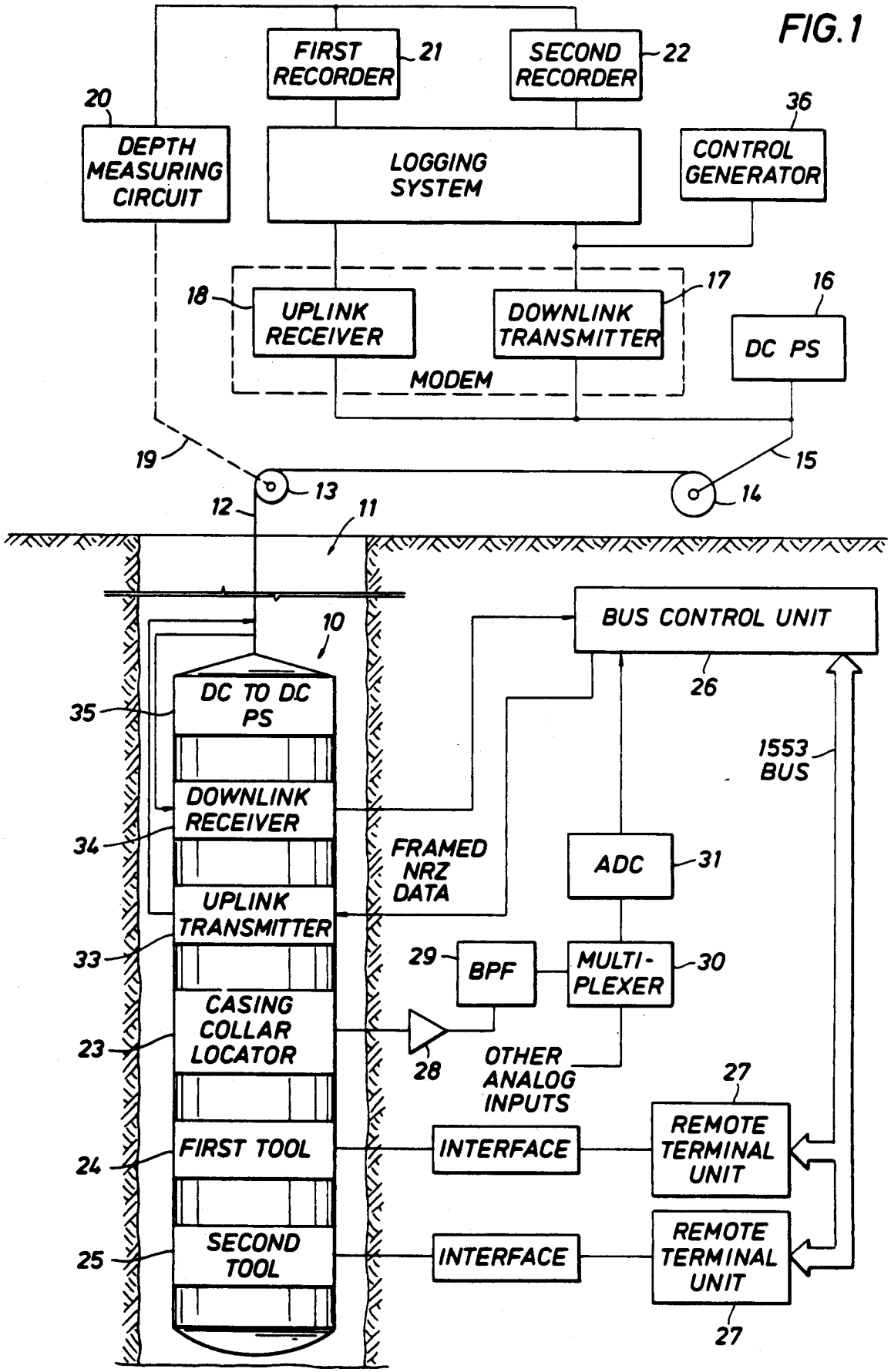
FIG. 1
FIRST RECORDER
21
SECOND RECORDER
22
20
DEPTH MEASURING CIRCUIT
LOGGING SYSTEM
36
CONTROL GENERATOR
18
UPLINK RECEIVER
DOWNLINK TRANSMITTER
17
16
DC PS
MODEM
19
15
13
14
12
11
10
BUS CONTROL UNIT
26
35
DC TO DC PS
1553 BUS
DOWNLINK RECEIVER
34
FRAMED NRZ DATA
ADC
31
UPLINK TRANSMITTER
33
29
BPF
MULTI-PLEXER
30
CASING COLLAR LOCATOR
23
28
OTHER ANALOG INPUTS
27
REMOTE TERMINAL UNIT
FIRST TOOL
24
INTERFACE
SECOND TOOL
25
INTERFACE
REMOTE TERMINAL UNIT
27

CONTROL GENERATOR
36
TO AGC AMP. 42
18

BPF
41
ENCODER
37
16
TONE GENERATOR
BPF
43
44
LPF
HV DC POWER SOURCE
38
39
40
17
14
13
12
45
35
LPF
POWER SUPPLY
15 V DC
5 V DC
200 V DC
46
34
53
54
55
56
4 POLE LPF
HPF
ENVELOPE DETECTOR
BINARY LEVEL SLICER
57
33
58
1553 ENCODER
51
NRZ DATA
26
50
CLOCK
BCU
49
LPF
DATA ENCODER
DATA SCRAMBLER
31
ADC
1553 BUS
47
MODULATOR
OTHER ANALOG INPUTS
MULTIPLEXER
30
DAC
28
48
23
CCL
B P FILTER
29

| AGC NORMALIZED DATA RANGE | SLICING LEVELS RANGE | SLICER OUTPUT | DECODED OUTPUT 4-LEVEL |
|---|---|---|---|
| 3.5 | | | |
| | | +3 | 2 |
| 2.5 | | | |
| | | +2 | 1 |
| 1.5 | | | |
| | | +1 | 0 |
| 0.5 | | | |
| | | 0 | 3 |
| -0.5 | | | |
| | | -1 | 2 |
| -1.5 | | | |
| | | -2 | 1 |
| -2.5 | | | |
| | | -3 | 0 |
| -3.5 | | | |

ADVANCED DIGITAL TELEMETRY SYSTEM FOR MONOCABLE TRANSMISSION FEATURING MULTILEVEL CORRELATIVE CODING AND ADAPTIVE TRANSVERSAL FILTER EQUALIZER

BACKGROUND OF THE DISCLOSURE

A telemetry system is set forth in the present disclosure which is particularly useful in well logging tools. It is particularly intended for use with one or more logging devices supported on a logging cable and enclosed within a sonde wherein the logging tools provide logging data at ever increasing data transfer rates. In particular, it is a telemetry system which will successfully operate on a single conductor (hence the term monocable) within the logging cable wherein the single conductor carries other signal and power transmission on the cable.

When first introduced, downhole logging tools performed measurements which transmitted signals to the surface as analog signals. As time passed, more sophisticated systems came into being including AM, FM, PCM, etc. Analog capacity reached the equivalent of about 4,000 bits per second using a PPM systems. Analog transfer, however, has become obsolete as digital computers have come to the front in execution of surface data processing. The present advanced logging systems use QPSK or three level duobinary coding. This has accomplished some bandwidth reduction by a factor of two fold. Cable parameters must be carefully determined and carefully monitored because analog equalizers are normally used to remove cable distortion. Obviously, not every cable is equally well made, and cables do vary in their transfer function so that cables cannot always be properly matched with telemetry systems. The present disclosure is directed to a telemetry system which can function without requiring extraordinary cable quality and will function notwithstanding variations in cable transfer characteristics.

In very general terms, the telemetry system has a downhole transmitter connected to a surface receiver. There is however the transfer function of the cable which inevitably distorts and attenuates the signal transmitted along the cable. The received signal must be processed so that the data of interest can be recovered without errors. The problem is made even more difficult because the monocable is often used for the transfer of other data. Data from the surface can be sent downwardly on the same monocable and must be accommodated so that instructions for operations of the downhole logging tool can be obtained. It is also common to place a DC voltage on the cable so that electrical power is transferred to the tool for operation of various electrical components in the tool. With this backdrop, the uplink data must be transmitted along the monocable subject to variable distortion, and transmission occurs in the presence of other signals interposed on the same current conductor.

The monocable is typically comprised of a single conductor with a shield or alternate conductor serving as ground. Data is created in the logging tool and has the form of a sequence of binary symbols. The logging tool telemetry apparatus will be described as converting the data from the logging tool into a selected format such as NRZ data, a mixed sequence of binary zeros or binary ones. The data is preferably transmitted at a particular clock rate. The downhole system preferably incorporates a scrambler provided with the NRZ data stream which distributes the ones and zeros in a pseudorandom sequence and also assures level transitions while avoiding forming a long fixed value. This makes it easier to operate the AGC (automatic gain control) amplifier and clock recovery circuit at the surface as will be described. The present apparatus first converts a stream of NRZ data bits to four level data by converting each successive two bits of NRZ data into one four level data symbol. The four level signal is then converted into a seven level duobinary-encoded signal that requires half the bandwidth of the four level signal and a fourth of the bandwidth of the original NRZ signal. As the type and diameter of the cable permit, the bandwidth for data transmission along the monocable increases. Even so, there is a limit to the maximum data rate that can be transmitted on any particular monocable given a particular noise environment. The modulation scheme described herein allows that maximum data rate to be more closely approached than previous modulation schemes. This type of data encoding, which compresses the required signal bandwidth, allows a higher rate of data transfer than any previous system would allow for any particular monocable.

The logging cable (defined as a pair of conductors) extending from the surface is a form of transmission line. The cable has a certain transfer characteristic. In fact, the monocable is a transmission line which has a limited bandwidth. If the data transfer rate is increased, cable limitations cause serious data degradation. One result of limited band width is the fact that signal output has reduced harmonic content so that the output is severely distorted and is primarily an analog signal. Adjacent digital symbols contribute to intersymbol interference when transmitted along the cable. As the distortion and interference increase and signal amplitude decreases, limits in data transfer capacity are encountered. In the present apparatus, seven pulse levels are used so that each level of the seven represents two bits of data. By using seven levels, bandwidth efficiency is increased and the data transfer rate is enhanced. The theoretical bit rate in this approach is in part limited by the permitted signal to noise ratio for quality signal transmission. The present system thus uses seven levels of digital data, the levels centered at zero and includes three symmetrical levels above and below zero. The data in encoded in a particular way (called multilevel correlative coding) to achieve the seven levels while limiting the transmission bandwidth of the signal. In summary, the bandwidth efficiency is four times that of a NRZ system using amplitude modulation. Use of seven level encoding permits correlation between adjacent data bits. Assume that the four state symbols can be encoded to the seven levels, leaving three of the states unused. The "surplus" states are selected to encode the four state symbol plus some aspect of adjacent symbols and hence assures improved data recovery by adjacent symbol correlation.

Appropriate coupling circuits separate the uplink telemetry system, downlink telemetry system, and DC power supply connections for operation on the monocable. The present disclosure is thus directed to a downhole sonde supported data encoding system. It also discloses a data receiving system which is installed at the surface. The equipment at the surface must reverse distortion that was created by the cable on the transmitted signal. If the cable were precisely fixed and unchanging, the nature of the distortion could be permanently known, but this is not the good fortune of operation. Rather, the distortion is variable. The distortion is overcome in a manner to be described below by use of an adaptive transversal filter equalizer. The adaptive transversal filter equalizer automatically adjusts its transfer function to correct for a variable amount of cable distortion which distortion must be assumed to vary dynamically.

A seven level encoding system is set forth, thereby enabling a single seven level symbol to represent two symbols decoded from NRZ binary. The seven levels make decoding more difficult, but it enables the transmission of far more data without increasing the required bandwidth in the monocable. Data recovery is limited by the signal to noise ratio. Accordingly, the downhole telemetry equipment converts the data from typical NRZ binary data into an amplitude modulated (AM) seven level duobinary set of symbols which are then filtered to limit the bandwidth of the transmitted signal and which is thereby converted into an analog signal. That signal is then amplified by a power amplifier for application to the monocable. Appropriate coupling circuits separate uplink transmitter data, downlink received data and poweer for opperation of the logging tool. The transmitted analog signal is propagated up the logging cable to the receiver. There, an uplink receiver having a filter separates the signal from downlink transmitted data and converts the received or uplink signal into a suitable signal for recovering the original data. The receiving apparatus at the surface includes an automatic gain control amplifier (AGC), a related clock recovery circuit to reconstruct the clock signal in the received uplink signal, an analog to digital converter and an equalizer and slicer circuit. The equalizer circuit in conjunction with the slicer circuit converts the digital signals into the encoding levels originally involved (seven levels in the preferred system). A descrambler circuit is included at the surface to reverse the effect of the downhole scrambler. Most sondes will support at least two different logging tools which form two different data streams. Assuming that a multiplexer is used in the sonde to transmit data from two or more tools, the data is transmitted in specific data frames. This is a time multiplexed sequence which is sorted by computer at the surface. So to speak, a demultiplexer is included at the surface by sorting time frames, and the several output data are then delivered for data processing and/or storage in typical recorders which record the data as a function of depth in the well borehole. In the preferred embodiment, the two or more tools in the sonde furnish data for transmission in response to surface originated signals; in that arrangement, data frames are interwoven, enabling transfer of two or more data streams. At the surface, the two or more data streams must be sorted out and in this regard, the recovered signal may require demultiplexing to separate multiple transmitted signals.

Emphasis should be focused on the equalizer and slicer. The equalizer is provided with digital values which ideally represent the levels of the encoded input, or seven levels in the preferred embodiment. However, because of unknown and variable distortions arising from variations in cable temperature and length, the input to the equalizer is not precisely at the seven levels originally transmitted. The received signal, after has error due to noise, phase shift, temperature variation, etc. Consider a seven level output system where 2.0 units amplitude is one of the digital levels. If the output of the equalizer is 2.18, slicing must occur to reduce that value to 2.00. In other words, slicing recreates levels matching the transmitted levels. Even where errors arise from the distortion to the signal occurring during cable transmission, such errors are removed by the present apparatus without regard to the precise transfer characteristics of the cable.

With the foregoing in view, the present apparatus is very briefly described as a logging tool telemetry system which transmits a multiple level signal outputting an analog signal after transmission along a monocable in the logging cable to surface located uplink telemetry receiving apparatus. The signal is processed through an AGC amp, is digitized by an ADC, the clock synchronization in the signal is recovered, and the output is then passed through an equalizer and slicer. The output is delivered to one or multiple recorders after data processing for recording thereby, and such data is recorded as a function of depth in the well borehole. The system operates substantially free of different or variable transmission characteristics of the monocable.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is a system view of a sonde supported on a logging cable and incorporating a telemetry system communicating along the logging cable to the surface wherein the telemetry system incorporates the present invention;

DETAILED DESCRIPTION OF THE PREFERRED EMBODIMENT

Figure 2:
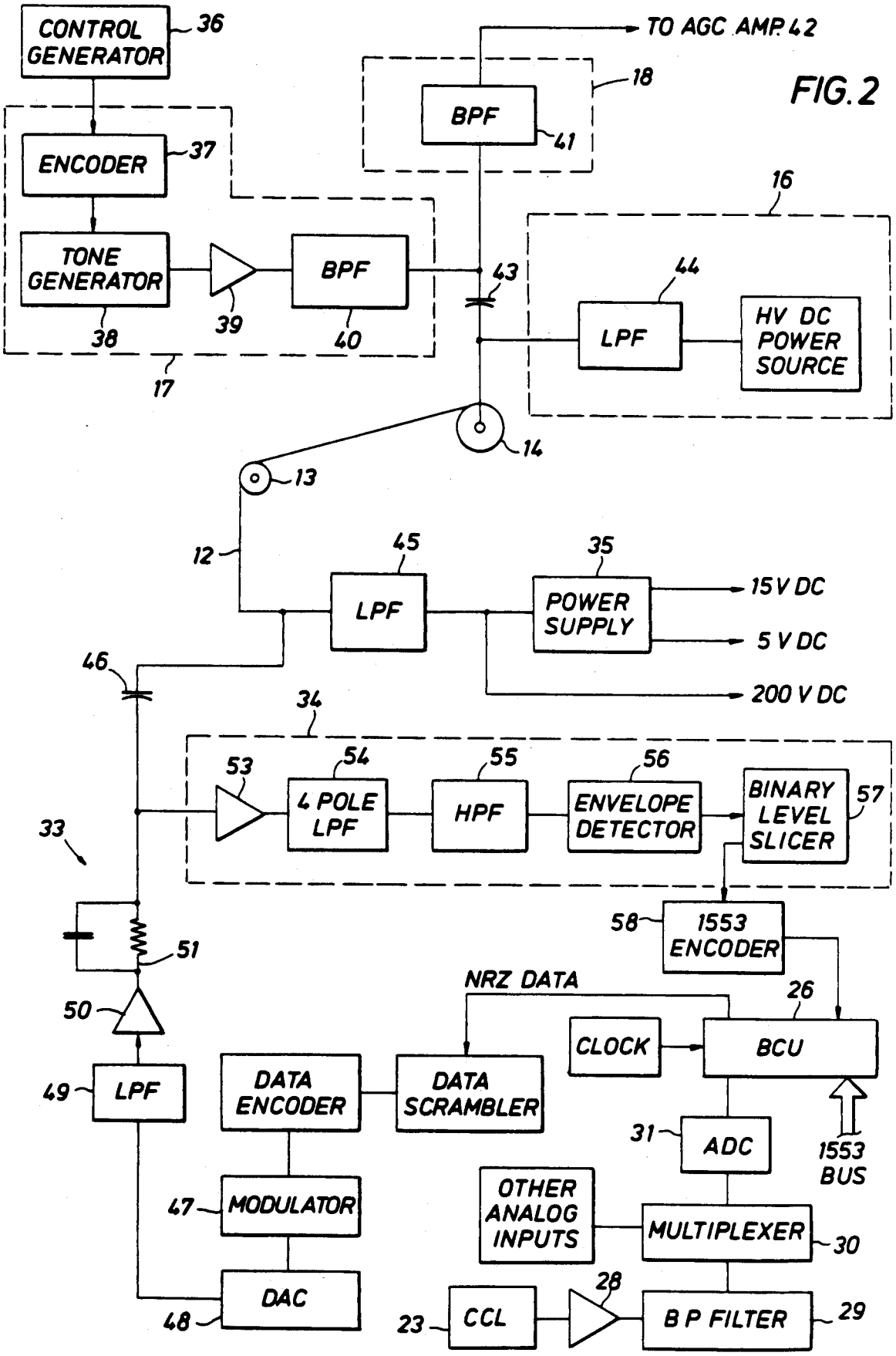
FIG. 2 is a partial schematic showing details of coupling circuits connected to the cable, both in the sonde and at the surface located equipment.

Attention is directed first to FIG. 1 of the drawings for a description of a logging system with special emphasis on the telemetry apparatus included with the logging system. FIG. 1 of the drawings shows a sonde 10 supported in a well borehole 11 and suspended on an armored logging cable 12. It can be used in open hole or in a cased borehole. For cased hole use, a casing collar locator is included in the sonde as will be described. However, the telemetry apparatus of the present disclosure operates with a logging sonde which is used in either type of borehole. The logging tool 10 is constructed with a well known hermetically sealed and fluid tight, pressure resistant housing which is supported on the logging cable 12. The logging cable is substantially long, indeed having lengths upwards of 25,000 or even 30,000 feet. It must be that long so the sonde can be lowered to the bottom of the deepest wells drilled. The logging cable 12 can be as simple as a single conductor cable. In accordance with industry standards, the cable also can include up to seven conductors. For purposes of this disclosure it will be assumed to incorporate as many as seven conductors. The present disclosure however will focus on a single electrical conductive path and appropriate ground connection through the cable so that this disclosure will deal with a single pair of conductors. The ground return in the cable can either be a conductor or the cable shield. The logging cable further includes a woven wire rope or equivalent for strength. It also typically includes a sheath or wrapping which shields the electrical conductors on the interior, and thus comprises a cable of sufficient strength to support the sonde 10 and the weight of the cable itself. The sonde 10 is lowered to the bottom of the well, and is retrieved on the cable 12. During retrieval, data is collected by surface located equipment. The data is provided through the telemetry link along the cable 12. Appropriate logging tools of different types are incorporated in the sonde. The precise logging tools can vary but includes those which are used for downhole well logging operations. The cable 12 passes over a sheave 13 and is directed to a drum 14 where it is spooled and stored. The entire cable is wound on the drum which is typically truck conveyed to the site of the well. There are one or more conductors in the cable which defines the monocable which is the term used hereinafter to describe the conductor pair without regard to the presence of other conductors. The monocable 15 provides an output connected to three different types of circuits as shown in FIG. 1. In part, the monocable 15 delivers electric power for operation and hence it is connected to a DC power supply 16. This furnishes DC current flow for operation of the sonde located equipment. The voltage is a few hundred volts and the current level can be substantial. Moreover, there is a downlink transmitter 17 which directs modulated signals along the monocable 15 to provide instructions for control and operation of the sonde 10. In addition, there is an uplink receiver 18 also connected to the monocable. Telemetry data from the sonde is transmitted to the uplink receiver. In summary, the monocable 15 must provide a current flow path for DC current sufficient to operate the equipment, and also carries different frequency signals for uplink and downlink communication. This disclosure particularly focuses on the uplink telemetry transfer through the monocable.

In operation, data is acquired while retrieving the sonde 10 from the bottom of the well and conducting measurements as it moves along the well borehole. The valuable data particularly must be provided as a function of sonde location in the borehole. To this end, a depth measuring apparatus 20 is connected with the sheave by a means 19 to obtain indications of cable retrieval. This forms a depth indication so that suitable data from tools to be described can be recorded as a function of depth. The depth measuring circuit provides an output to a first recorder 21 and a similar second recorder 22, the two the recorders providing strip charts of important data about the well as a function of depth. The surface located logging system will be described in detail below.

In the sonde, there is a first measuring apparatus which is a casing collar locator 23. There are additional formation measuring tools 24 and 25. The measuring tools 24 and 25 are located in the sonde. They can be any type of tool appropriate for logging. For example, the tools 24 and 25 can include devices known in the art for measuring resistance of the formation, tools for measuring porosity, tools for measuring specific concentrations of potassium, thorium and uranium, etc. The tools may use any type of stimulus including irradiation of adjacent formations with high frequency radiation or bombardment with neutrons. Without regard to the wide variety of tools, it is sufficient for purposes of this disclosure to note that the tools 24 and 25 each provide output data formed into a data stream. The data stream may be series or parallel words, and the encoding can also vary. The data stream will at various points be converted into the NRZ format, or no return to zero. The NRZ format is converted in subsequent portions of the system and is therefore discussed at this juncture. Another format is the 1553 format conveniently used for transfer from individual tools to a bus control unit. The data from the tools 24 and 25 can be in the 1553 format and may be readily converted to this or any other format. The data streams from the tools 24 and 25 along with data from the casing collar locator are all delivered to a bus control unit (BCU) 26. The BCU is commanded from the surface via downlink instructions that in turn operate the various tools to therefore deliver uplink data in patterned interleaved bursts. The data flow is continuous but has the form of bursts or frames of specific length and organization. The output from the BCU 26 is preferably an NRZ sequence of data which is organized in appropriate data blocks or frames based on operation of the BCU 26. All of this data organization is under control of commands from the surface. This assures that the data delivered on the monocable 15 is organized in such a fashion that the significance of the data can subsequently be determined. Each of the tools 23, 24 and 25 forms data connected through suitable interfaces to a remote terminal unit (RTU) 27. The tool data, when commanded, is placed on a bus to the BCU 26. One acceptable data format enables each of the tools to form individual data blocks with suitable identification and measured values. The collar locator 23 provides meaningful data by locating collars every thirty feet (or if longer collars are used, once in forty feet).

SUBSURFACE DATA CONVERSION

Figure 3:
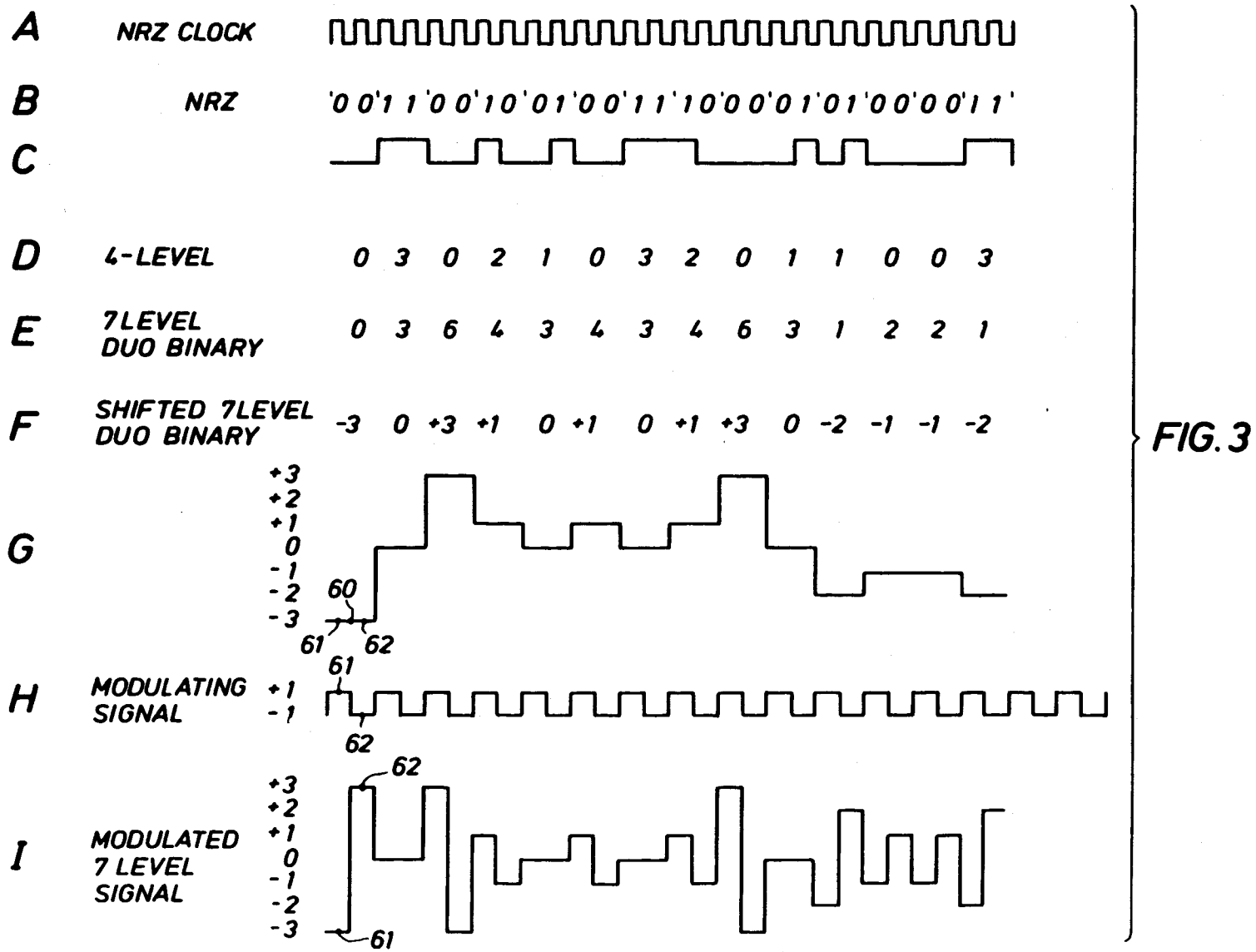
FIG. 3 is a chart showing related levels and wave forms for data encoding to provide an amplitude modulated seven level signal for telemetry transmission.
Figures 4, 5:
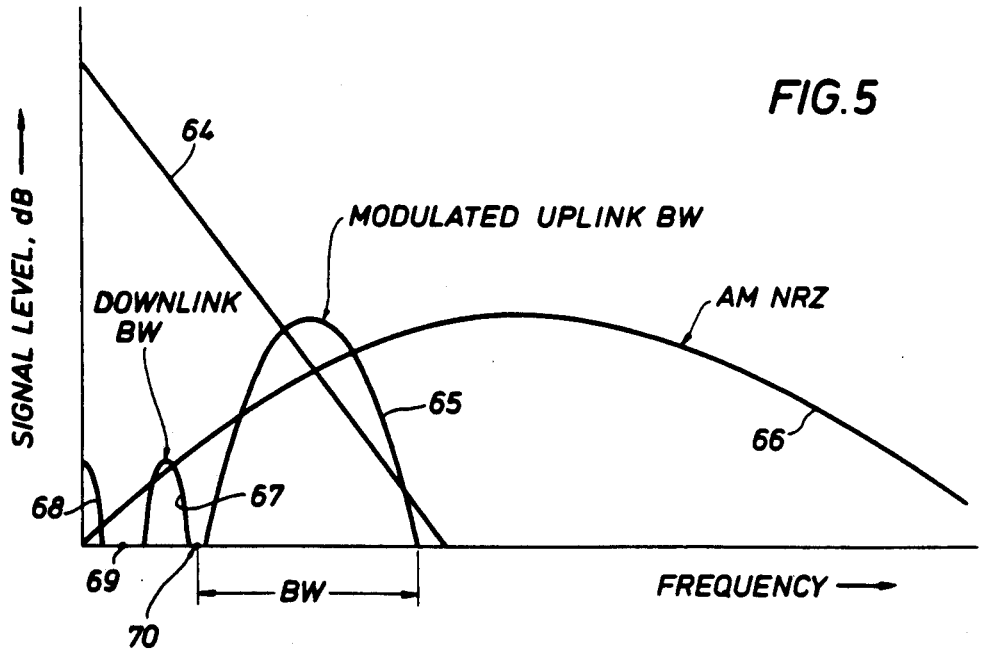
FIG. 4 is a chart of values received after telemetry and includes columns for the normalized data value, the incremental or slicing value removed therefrom, the output after slicing, and the decoded output.
FIG. 5 is a graph of signal level versus frequency showing bandwidth efficiency improvements.

The output of the BCU 26 is a stream of data in NRZ format. It is delivered to a scrambler in FIG. 2 to be described. The scrambler avoids an excessive number of zeros or ones in the data string. The scrambler converts the data string so that there is a pseudorandom mix of zeros and ones. The data is then delivered to an encoder and converted into a seven output levels. The seven levels are 3, 2, 1, 0, −1, −2 and −3. FIGS. 3, 4 and 5 of the drawings show how the seven logic levels are implemented by conversion into specific voltage levels and recovery after transmission. The seven logic levels are distorted as they are transmitted so that some type of recovery is made to overcome the distortion to restore distorted values to specific output levels. For the moment, it is important to note that the seve level representation has the form shown in the drawings. Since the input is in NRZ format, two consecutive NRZ bits input to the system form four level encoding. The encoder therefore takes two adjacent NRZ data bits and converts the two data bits into a four level symbol which is converted into one of the seven levels output by the encoder. Significance of the seven level encoding will be set forth hereafter.

A sequence of symbols is output from the encoder. The encoded seven level data flow is modulated and then supplied to the digital to analog converter. There, the digital representations are converted into an analog signal. The analog signal is then supplied to a filter. The filter removes a substantial portion of the harmonics to assure that the data will fit within a particular bandwidth and not interfere with adjacent signals, the width of that pass band being discussed regarding FIGS. 3, 4 and 5. The bandwidth is selected so that the data in analog form will fit within the pass band permitted for the monocable 15 and not interfere with adjacent signals. That signal is output to a power amplifier which provides an adequate drive input to the cable 15 for transmission. The amplified signal is delivered to an uplink transmitter 33 (FIG. 1) which forms an output delivered to the monocable 15. This is part of the telemetry interconnection whereby multiple signals are conveyed along the monocable. The transmitter 33 sends the data up the monocable 15.

The sonde also encloses a downlink receiver 34. It forms an output control signal from the received surface instructions and provides appropriate control signals to the BCU 26 which in turn directs operation of the various logging tools within the sonde 10. The sonde also encloses a DC to DC power supply 35. The power supply 35 is provided with current from the DC power supply 16 at the surface and converts the current into one or more appropriate DC levels for operation of equipment within the sonde. The monocable 15 connects to three different units operating from the monocable.

As mentioned earlier, the monocable provides a conductive path for DC current for operation of the sonde power supply 35, and also two way communication is sustained over the monocable between the uplink and downlink transmitters and receivers. These are operated at different frequencies so that they can be easily separated.

SURFACE EQUIPMENT

At the surface, there is a control generator 36. Through it, instructions are directed to the sonde which operate the BCU 26 which in turn causes operation of the measuring tools within the sonde. This enables a surface operator to direct the equipment so that it performs in the intended fashion.

The monocable 15 is connected to the uplink receiver 18. The signal transmitted from the sonde 10 and particularly the signal which is multiplexed, scrambled, encoded, modulated, converted into an analog shape, filtered, and then amplified is delivered after attenuation by the monocable 15. The amount and nature of the attenuation is variable. In part, signal distortion depends on whether or not the cable is spooled or unspooled. In part, it depends on the physical dimensions of the cable and especially the length of the cable. In part, it depends on the temperature of the cable at the surface and then in the borehole. In part, it depends also on cable tension. In part, it depends on the distributed circuit values in the cable which functions as a long transmission line. This signal distortion can be analyzed in the laboratory, but that is difficult because the cable is dynamically used by spooling and unspooling during operation. In any event, the cable has a transfer function which is not specifically known at all times and which transfer function is interposed between the uplink transmitter 33 and the uplink receiver 18 at the surface. If distortion were a fixed quantity, difficulties would be avoided. It is not fixed but is variable so that the surface located equipment must be incorporated to provide a usable output from the logging tools and the sonde 10.

MONOCABLE CONNECTIONS

FIG. 2 of the drawings show certain of the components in greater detail. Specifically FIG. 2 includes the control signal generator 36. It forms instructions for the downlink transmitter 17. That equipment preferably includes a pulse encoder 37 which connects with a tone generator 38. The tone is amplified by a line drive amplifier 39, and the signal is output through a band pass filter 40 which drives the monocable 15. The encoder preferably forms data into the data protocol selected for use, the preferred being the Manchester 1553 format.

The monocable connected equipment also includes the uplink receiver 18. That has a band pass filter 41 connected to the AGC amp, described later. The surface equipment also includes the DC power supply 16. That is connected to the monocable 15 directly. The uplink receiver 18 and the downlink transmitter 17 are isolated by a blocking capacitor 43. The power supply is connected with the monocable 15 by means of series inductors and a grounded capacitor in a low pass filter 44.

Summarizing the foregoing, it will be observed that the two telemetry systems, one for transmission upwardly and the other for transmission downwardly, operate at different frequencies which are isolated from one another by means of appropriate filtering circuits. Thus, the various band pass and low pass filters prevent intrusion of data from other surface connected equipment. In summary, the three connected sets of equipment at the surface in FIG. 2 have electrical isolation as a result of choice of proper operating frequencies.

In the sonde, the following equipment is included in FIG. 2. First of all, the monocable 15 connects into the sonde and DC power is obtained for the power supply 35. It is a DC to DC power supply. Any AC on the monocable 15 is blocked because the DC current is input through a low pass filter 45. DC on the monocable is blocked from the telemetry equipment by the blocking capacitor 46. The uplink system includes a data scrambler serially provided with the NRZ data flow output. The scrambled NRZ data flow is encoded by an encoder; the scrambler and encoder are described in greater detail later. The seven level encoded data stream is modulated by a modulator 47 and then is converted to analog by a ADC 48 connected to a LPF 49 and then is amplified by an amplifier 50. The amplifier 50 connects to an LC tank circuit 51 to drive the monocable 15. This delivers the high power uplink transmitted signal. In addition, the sonde 10 encloses the downlink receiver 34. The receiver signal is input into an amplifier 53, then low pass filters 54 and 55, then an envelope detector 56, a binary level slicer 57 and a 1553 format decoder 58. That forms NRZ data which is delivered to the BCU 26. This provides the surface directed operational signals for the sonde 10.

In summarizing FIG. 2, it will be observed that the monocable 15 is used for transmission of AC data at different frequencies within specified pass bands in opposite directions. In addition to that, the monocable 15 provides a current path for DC power transmission so that adequate operating power can be provided. The BCU 26 receives signals in two forms, one being the 1553 format. The casing collar locator 23 detects the proximity of collars and forms an analog output signal. FIG. 2 shows how this signal (and other analog signals) are input to an amplifier 28, then a filter 29, and then to a multiplexer 30, assuming two or more inputs. The multiplexed data is converted to digital (NRZ) form by an ADC 31.

DESCRIPTION OF THE SIGNAL WAVE FORMS

Attention is directed to FIG. 3 of the drawings which view has been divided into several portions which are vertically related to one another. This will describe how data is converted, and will be related to the response of the cable 12 in discussing FIG. 4, and will also be related to the operation of the equalizer and slicer including the filter system. At FIG. 3A, a clock pulse is illustrated. A data stream of zeros and ones in a random mixture is shown at FIG. 3B. This data made up of zeros and ones has the pulse waveform shown at FIG. 3C, and is typical. The data at FIG. 3B is grouped into pairs of bits, it being recognized that two bits define four separate states. A four level translation is shown for the data at FIG. 3D. In turn, that is translated into a seven level representation at FIG. 3E. Thus, there is a correspondence where the values of zero, one, two and three in FIG. 3D are converted to seven levels. Once seven levels are defined, they are shifted by subtracting three from each value. As shown in the data at FIG. 3E, all the values are positive; when three is subtracted from each entry, level shifting is accomplished to provide a data stream centered about zero; that is, the distribution of entries provides approximately half above and half below zero. It will be observed that there are three redundant levels in the seven levels; the three redundant levels are correlated with the other levels primarily to reduce the bandwidth. Also, the three redundant levels are used to detect errors in the receiver. FIG. 3F shows the shifted seven levels; FIG. 3G merely represents the same data in graphic form. This also represents the modulating signal which is used to amplitude modulate (AM) a carrier signal which is provided at FIG. 3H. The carrier in this illustrative instance is at twice the NRZ clock frequency or provides two cycles for every one cycle shown at FIG. 3A. Restated, the time period required for one cycle of the carrier or modulating signal shown in FIG. 3H is equal to the time period required for each data symbol shown in FIG. 3G. Since the modulating signal has a digital form, it has the effect of converting each cycle at FIG. 3G into equal and opposite positive and negative peaks shown in FIG. 3I. Perhaps an example will help illustrate this and will further assist in the explanation of the telemetry system of the present disclosure.

That explanation will be more valuable when considering what occurs when the wave form at FIG. 3G is periodically sampled. The numeral 60 indicates a point which is precisely half way through the cycle which is shown at FIG. 3G. If that were the sampling point at which time measurements of the pulse were made, this data would be highly accurate because it would be remote from the transitions which occur at the beginning and end of each cycle time. If however the carrier signal shown at FIG. 3H has twice the frequency as the signal shown at FIG. 3G, the point 60 would be approximately at the transition instant and would therefore be highly undesirable as a point at which measurements are made. Since the frequency at FIG. 3H is precisely double, sampling at the point 60 is highly undesirable because of this lack of certainty. Rather than use the point 60, the points 61 and 62 are preferred. The points 61 and 62 occur at the 90° and 270° instants in the cycle of the modulating signal at FIG. 3H. In other words, these are the most stable times so that sampling of the signal wave form is assured of maximum signal stability. These sample times also occur when the signal to noise ratio is better. The points 61 and 62 are at the greatest extremes relative to the state change in the modulating signal at FIG. 3H. Modulating the wave form at FIG. 3H with the wave form at FIG. 3G yields the modulated peaks shown at FIG. 3I. There, the sample points 61 and 62 are now at opposite polarities. The present apparatus prefers a modulating signal in conjunction with the data to be transmitted. If samples are selected corresponding to the sample times at 61 and 62 shown in FIG. 3I, and if the samples were actually measured, the digital values for the data points at 61 and 62 should be equal and differ only by sign. In other words, the amplitudes of the points 61 and 62 should be equal, and differ only by sign. This is true of every four level symbol shown at FIG. 3D. In summary each consecutive symbol is converted into seven levels, thereafter being shifted as shown at FIG. 3F, and after modulating by the signal at FIG. 3H, yields the modulated carrier shown at FIG. 3I. This has a valuable attribute which will be discussed below.

Assume now that the modulated wave form at FIG. 3I is transmitted on the monocable 15. Assume further that the data points 61 and 62 represent 3.0 units which, on decoding, convert into the indicated four level symbol and then the NRZ symbols shown in FIG. 3. Assume on reception that the AGC amplifier outputs the distorted signals. Going now to FIG. 4 of the drawings, the data point 61 is assumed to be in the range of about −2.5 to about −3.5 as shown in the left hand column. The data point 62, on the other hand, might be in the range of about 2.5 to about 3.5 as described in the left hand column. The equalizer described below is omitted for sake of describing FIG. 4 columns proceeding across the page.

The next column shows the ranges in which slicing must occur. Considering the top most entry, namely the range of 2.5 to 3.5 units, this is a range of 1.0 in which slicing must occur. Assume further that the signal level of 3.0 was transmitted, but the received signal is any value between 2.5 and 3.5. Slicing involves adjustment of the signal output to 3.00. That is shown in the third column of FIG. 4 and that data symbol is ultimately decoded to the four level output which is shown in the right hand column. For example, assume that the AGC output value is 3.18. This requires slicing or subtraction of 0.18 units to obtain the slicer output of 3.00 units. A similar slicing operation is required if the AGC output is 2.92 in which instance slicing would involve the addition of 0.08 units to obtain the output of 3.00. This operation can be repeated for all the various slicing ranges in FIG. 4. It is noted that each range is equal in width, being 1.00 units in this measurement system. Thus, the seven slicer output levels are shown. One feature of the tabular entries in FIG. 4 is the redundancy found in conversion from seven levels at the slicer output to the decoded output of four levels. Interestingly, of the four levels, three of the four levels have ambiguous or two different corresponding slicer output levels. For instance in the four level system, a zero is represented by slicer output signals of +1 and −3. In summary, FIG. 4 shows how the filtering system makes the conversion, how slicing is implemented, and how reconstructed levels are obtained for the seven level encoding system which is subsequently decoded to four levels and which in turn is utilized for data conversion.

FIG. 5 shows a plot of signal level in dB versus frequency. In particular, this refers to the signal loss in transmission of the telemetry signal along the monocable 15. The line 64 identifies the loss associated with a typical logging cable. One example is a logging cable of 30,000 feet length enclosing a single conductor in a cable 7/32 inch diameter. It is not uncommon to have a loss of about 70 dB at a frequency of 40 kilohertz. Using the seven level amplitude modulation system as taught herein, such a logging cable can be used to provide a transfer rate of 54.4 KBPS. This would not otherwise be possible in a bandwidth of less than 40 kilohertz. By selection of a carrier frequency of 27.2 kilohertz, and the efficient use of a bandwidth of 27.2 kilohertz, 54.4 KBPS data rates can be sustained. This would then require a maximum frequency transmission on the cable of 40.8 kilohertz. Specifically in FIG. 5, this would provide a maximum frequency of 40.8 kilohertz, a center frequency of 27.2 kilohertz, and a minimum frequency of 13.6 kilohertz. The signal level response as a function of frequency is exemplified in the wave form 65.

The wave form 65 should be compared with the wave form 66. This is the frequency spectrum required to transmit at an equal rate AM NRZ data on the cable. Band width efficiency is markedly improved by the seven level conversion transmitted in an AM mode with a carrier as described in the present disclosure. Another valuable benefit of this type transmission is that frequency separation can be accomplished for the downlink data. Recall that the wave shape 65 represents the uplink data bandwidth. The downlink data bandwidth 67 can be spaced in frequency from the bandwidth 65 so that the two do not interfere with one another. Last of all, there is a DC power bandwidth 68 which has been exaggerated in width for illustrative purposes. The three illustrated bandwidths in FIG. 5 define the frequency points 67 and 70 on the abscissa which are filters cutoff frequencies. Consider first the frequency at 69. This particular frequency is implemented in the filters 44 and 45 to assure that the DC current required for operation of the power supply system is frequency isolated from the downlink bandwidth. The downlink bandwidth falls between the frequency points 69 and 70. These two frequency points are implemented in the band pass filter 40 in the surface equipment for the downlink transmitter 17. The frequency point 70 is also involved in the uplink filters shown in FIG. 2; that is, the uplink transmitter 33 includes the band pass filter 52 which has a lower cut off frequency corresponding to the frequency point 70. In like fashion, the lower frequency of the band pass filter 41 at the surface is also set at this level. This assures that the three signals transmitted on the monocable are frequency isolated at the surface.

DATA ENCODING CIRCUITS

Figure 6:
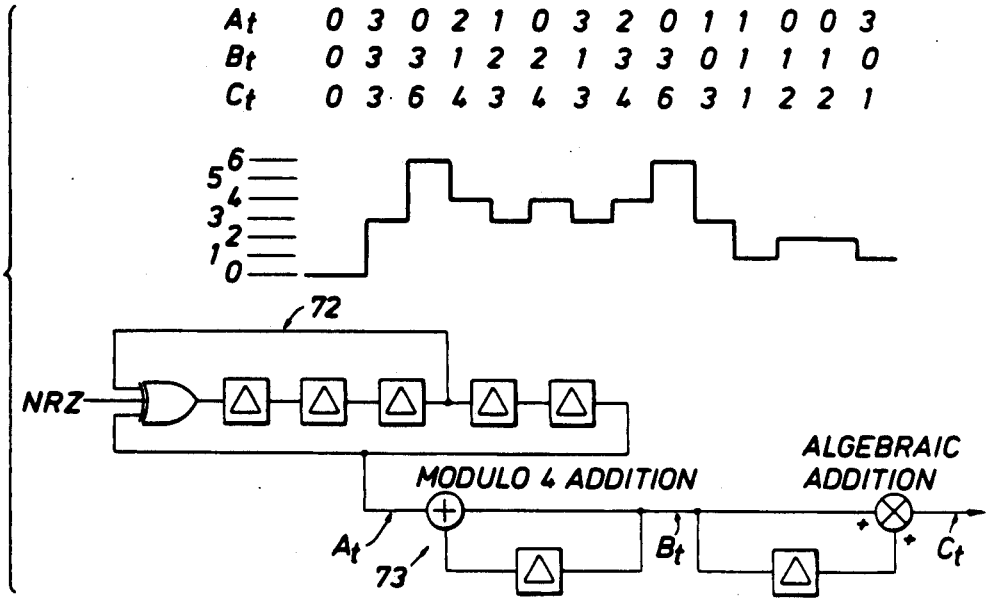
FIG. 6 is a sonde located scrambler and encoder.

Going now to FIG. 6 of the drawings, the scrambler is shown. The simplified scrambler 72 receives an input in the NRZ format, and which is supplied to an exclusive OR gate. That gate is connected with a delay line providing five incremental delays formed by five identical delay line stages. The delay line outputs from stages three and five connect to the input of the OR gate. The output is thus a pseudorandom scrambled NRZ. Scrambler lockup is prevented by an input counter preventing a long string of zeroes or ones when the consecutive entries exceed a selected number. The scrambler 72 is matched by a descrambler at the surface again formed of five equal delay line stages which form outputs from the scrambled NRZ input. They are connected to a similar exclusive OR gate so that there is a reversal in the descrambler of that which was accomplished in the scrambler 72. The encoder 73 accomplishes the conversion of 2 bits of NRZ data into a four level symbol and then into a seven level symbol. This is represented below where At, Bt and Ct are:

$$At = Bt \ominus \Delta Bt \text{MODULO } 4$$

$$Ct = Bt + \Delta Bt \text{ALGEBRAIC}$$

FIGS. 3C, 3D and 3E graphically show data conversion.

Figure 7:
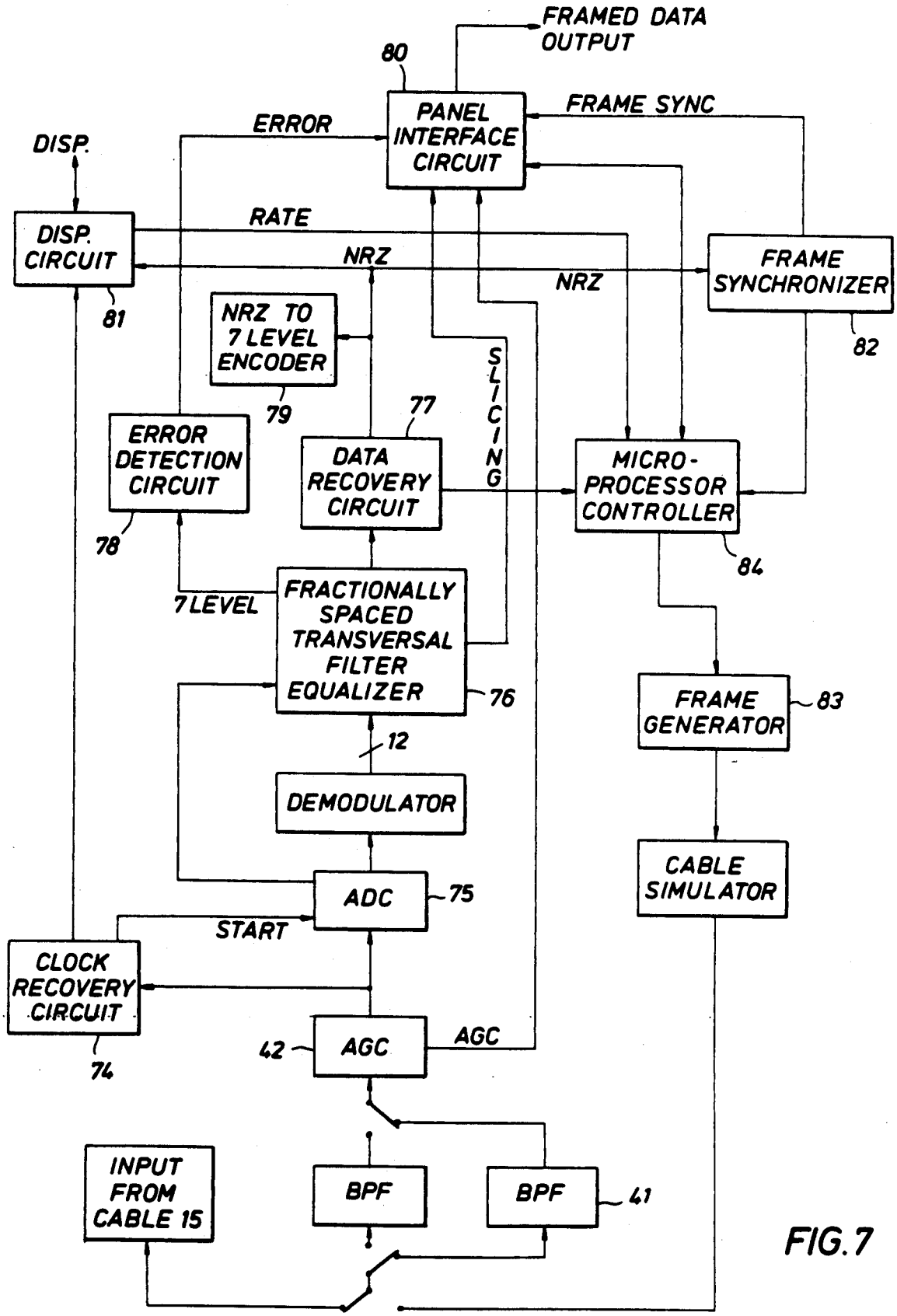
FIG. 7 is the surface located telemetry receiver system.

Attention is now directed to FIG. 7 of the drawings for a detailed description of the logging system located in the surface equipment and connected with the uplink receiver as illustrated in FIG. 1. FIG. 2 shows an input band pass filter 41 which then provides the analog signal to the AGC amp 42, both shown in FIG. 7. The output is amplified by an adjustable amount. The amplified analog output signal is provided to a clock recovery circuit 74 and also input to an analog to digital converter, the ADC 75. Even though the signal originated as a multilevel digital signal, it is nevertheless converted into an analog signal subject to distortion on transmission along the monocable 15 so that this conversion to analog values and subsequent cable transmission obscures any sharp delineations which might otherwise provide a clock synchronization signal. Synchronization signals are in the received analog signal, but they must be extracted by the clock recovery circuit 74. That circuit provides an output clock pulse which is delivered to the ADC 75 to trigger and synchronize its operation.

The ADC 75 digitizes the input signals. For instance, assume that the signal shown at FIG. 3I is transmitted onto the cable. Assume further that the signal loses a substantial portion of its high frequency components. In that event, the analog signal is received at the surface and is digitized. The clock signal is recovered as mentioned, and digitizing occurs ideally at the times 61 and 62 in FIG. 3. This forms two consecutive digital words each having a sign bit. The sign bit indicates the opposite polarity of the two adjacent digital words representing the values from the points 61 and 62. These words are input to the fractionally spaced transversal filter equalizer 76 after demodulation (or reversal of the sign bit on one of the two words). That circuit will be explained in some detail hereinafter. It is sufficient to note for the moment that it forms an output which represents the seven levels of data which were transmitted up the monocable 15, and those levels are adjusted by means of the slicing routine (described below) which assists in bringing the levels to the precise or sliced values illustrated in FIG. 4 of the drawings. In other words, slicing occurs so that seven levels can be provided. That is delivered to the data recovery circuit 77. Simultaneously, the signal is delivered also to the error detection circuit 78. The output of the data recovery circuit (to be described in detail below) is in the form of NRZ data. NRZ data is again encoded by an encoder 79 and that data stream is then provided to the error detection circuit 78. The two data streams are compared to detect errors. The errors are output to a panel interface circuit 80. Ideally, the errors are avoided by continual readjustment of the operation of the equalizer circuit 76, again as described below in detail.

A display circuit 81 is connected to the NRZ data stream output from the data recovery circuit 77. It is also provided with the clock from the clock recovery circuit 74. These signals provide proper timing and assist in display of the data should this be of interest.

The data stream which has been recovered in the circuit 77 is delivered in NRZ form to a frame synchronizer circuit 82. It is provided with this data stream, and organizes the data into frames or bursts. Recall that the downhole equipment may well transmit signals from two or more different logging tools. The data is organized into frames for transmission up the monocable. In that sense, the time based organization represents a type of multiplexing. The frame synchronizer 82 functions along with a frame generator 83 to group the data in the same frame organization arrangement. That is, the data is grouped so that the frames at the surface correspond to the frames of data transmitted from the sonde. The frame synchronizer provides a timing pulse to the panel interface circuit 80 which in turn provides the output data in framed format to be supplied to the various recorders shown in FIG. 1. The system further includes a microprocessor controller 84 which controls timing of operation of the various components in response to recreated clock pulses derived by the circuit 74.

Figure 8:
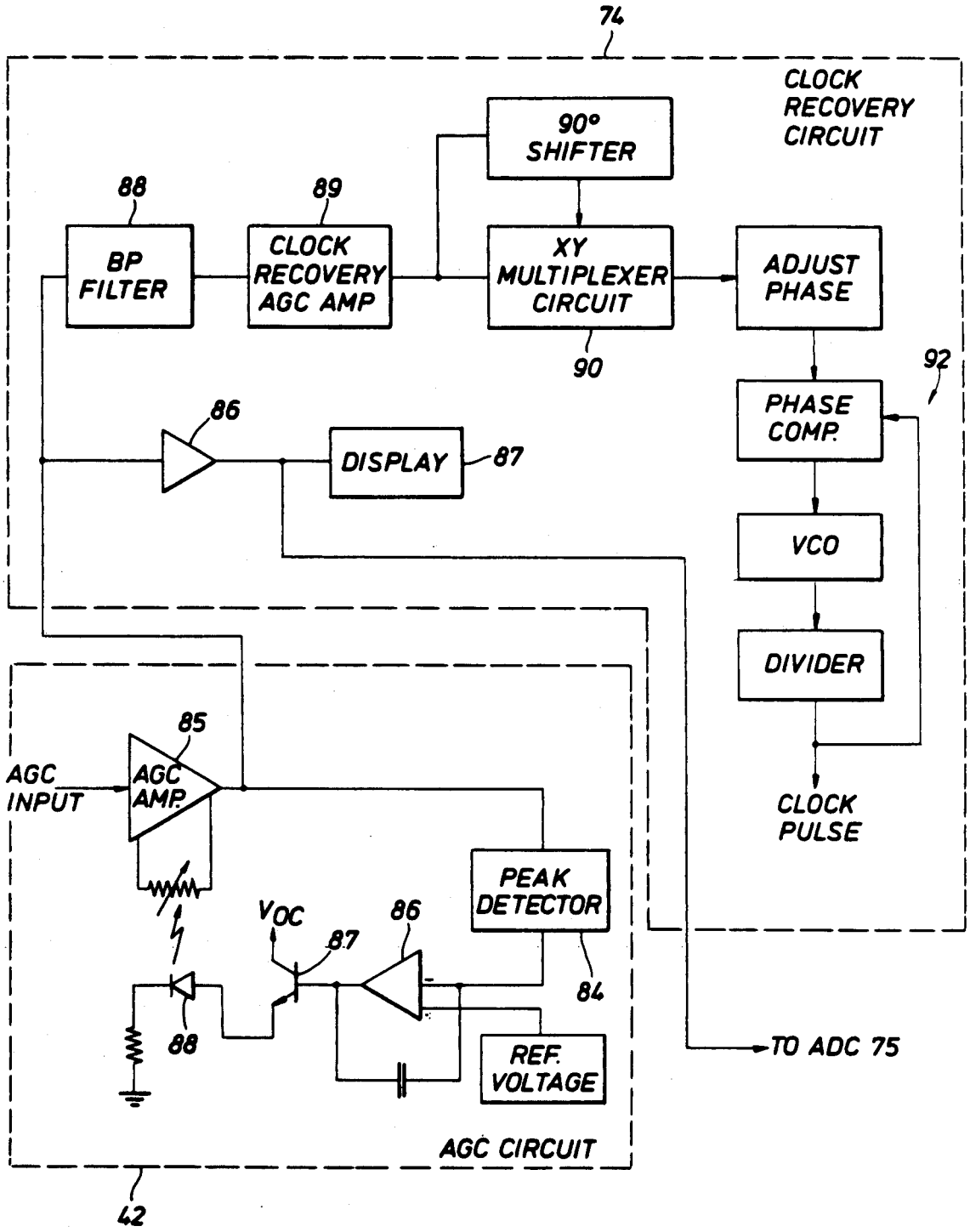
FIG. 8 is the surface located AGC amplifier circuit and clock recovery circuit.

Attention is now directed to FIG. 8 of the drawings for a detailed description of certain portions of the AGC amplifier. The input signal is delivered to an instrumentation amplifier 85 the gain of which is controlled by a single resistor. The resistor however is a light sensitive device which enables implementation of a feedback control signal. The output of the AGC amplifier 85 is provided to a peak detector circuit 84. Peaks are thus detected and an output signal indicative thereof is compared to a reference voltage by a differential amplifier 86. The amplifier 86 is also provided with a feedback capacitor and therefore functions as an integrating circuit, integrating the difference between the peak detector output and the control reference voltage. The output is delivered to a transistor 87 connected as an emitter follower circuit. It provides an output signal to an LED diode 88 which emits light observed by the light sensitive resistor. This controls the feedback loop so that the gain of the AGC amplifier is varied over approximately 1,000 fold variation in order to produce a peak voltage from the AGC amplifier 85 that matches the control or reference voltage input to the amplifier 86. The output of the AGC amp 42 is thus delivered through a buffer amp 860 and is then conveyed to a display 87. The output is also delivered to the ADC 75. FIG. 8 also shows the clock recovery circuit 41. The amplified analog signal is delivered to a band pass filter 88. The band pass filter provides an output to an AGC amp 89 and then to a multiplier circuit 90. It is also output to a phase shifter 91 and that signal is then provided to the multiplier 90. The two signals are multiplied together which creates an output signal containing a spectral "line" at the carrier frequency.

The type of modulation is a form of suppressed carrier in the telemetry system and fairly well suppresses the carrier which would otherwise incorporate the clock signal. This form of suppressed carrier modulation removes the carrier so that there is no particular bright spectral line in the received data. Rather, the transmitter energy is devoted to the modulating signals so that energy is not wasted in carrier transmission. Accordingly, the clock frequency is found most conveniently by distorting the signal which creates a richer mixture of harmonics of the carrier even though the carrier may not be readily observed at this stage. This therefore utilizes the foregoing harmonic creation and phase shifting and multiplication to create a signal richer in harmonics and in particular harmonics relating to the clock signal. A phase adjustment circuit is output to a phase lock loop circuit 92. This utilizes a phase comparator output to a voltage control oscillator and divider so that the clock signal is recovered and output by the circuit 74. Since the NRZ clock is two times the pulse rate of the data, use of the clock at this rate enables easy demodulation. The data stream is simply inverted for one half cycle. In FIG. 3I, the inversion restores the data points 61 and 62 to common polarity, or recreates the wave shape at FIG. 3G. The demodulation occurs after the ADC and simply reverse the sign of alternate digital words. The latter approach is the preferred demodulating mode and has value for reasons stated below.

DESCRIPTION OF EQUALIZER AND SLICER

The present system utilizes an equalizer and slicer to adjust the reconstructed pulses so that proper pulse height can be obtained. Recall that the transmitted NRZ signal is encoded in the form of seven pulse levels which are represented as 3, 2, 1, 0, −1, −2 and −3 units of amplitude. Utilizing typical voltage levels which are involved in IC circuitry, the foregoing seven signal levels can also be the voltage values. In any event, the data is delivered to the ADC in analog form. Recall that the clock rate for the ADC is reconstructed by the circuit 74. The reconstructed clock rate is preferably doubled so that the ADC sampling rate is doubled. Ideally, two samples are taken for every symbol of data which is input to the monocable 15. The two samples are taken, and thereafter, alternate samples are provided with sign reversals so that a single symbol input to the monocable 15 is converted into a wave form (see FIG. 3I) having the proper amplitude but also having both a positive going and negative going cycle. This double sampling approach greatly improves operation of the equalizer, making it much less sensitive to timing error and assists in avoiding problems which might arise as a result of digitizing at the edge of the pulse where zero crossing might well legitimately occur. This double sampling approach is a "fractionally spaced" equalizer system involving a transversal filter. Other sampling rates could be used to provide a different fractionally spaced equalizer system. The double rate is most desirable for the demodulating feature implemented by sample sign reversal for alternate digital values.

In any event, the ADC delivers digital words in series, there being an appropriate digital word representing the amplitude of the analog signal input. The digital word input will be represented by the symbol Y(T) which represents a particular digital word occurring at a particular time and which is synchronized with a particular data pulse transmitted in polybinary form from the sonde 10. The value Y(T) is measured for each of the two digital values at 61 and 62 and the demodulation is accomplished by sign reversal of every other word. Recall that end of cycle (or zero crossing) digitizing may create serious error; Y(T) is much more reliable after averaging. The equalizer is a fractionally spaced transversal filter which compensates for distortion in the signal resulting from the logging cable. The preferred filter is an adaptive finite impulse response (FIR) filter. Fractionally spaced refers to the fact that the input signal is sampled more often than one sample per data symbol. In this instance, it is sampled twice per cycle so that two samples represent a single symbol or a single polybinary level. This avoids sensitivity to sampling phase and thus makes accurate clock recovery of the transmitted clock signal less critical. This enhances timing of the data because the two samples enable quantification of the center of each data symbol.

Consider operation of the equalizer from a theoretical point first after which the drawing thereof will be described and related to the operation. The procession of digital words Y(T), Y(T+1), etc. is input to temporary memory. The filter design utilizes an adjustable or selected number of taps, and the selected approach is to use thirty-two taps. Accordingly, thirty-two words of data are stored in the memory at an instant at which reconstruction of the transmitted signal occurs. As an example, this filter system enables the telemetry system to respond in the event the cable is deployed in an excessively hot well. In this example, consider logging operation where the cable is stored on the surface as a coil and has an ambient temperature at 0° F. The cable is then lowered quickly into a deep well where the lower portions of the cable are exposed to high temperatures, perhaps as high as 400° F. The act of deployment, the uncoiling and the change in temperature all create changes in cable impedance characteristics which cannot be predicted and which are interposed between uplink transmitter and receiver to thereby distort the received signal. In examples such as that, the present apparatus is able to overcome changes even as those changes modify the shape of the received polybinary signal. The filter utilizes the time delay in the processing of n consecutive words in conjunction with n coefficients in operation of the filter. The output value is the sum of the 32 (n=32 in a practical form) words multiplied by the respective n coefficients.

In general terms, a least means squared stochastic gradient algorithm is implemented in the below written relationship for determining new coefficients so that the slicing error is constantly reduced. This helps the system accommodate changes such as that exemplified above where the logging cable is coiled at a cold temperature on the surface and is then uncoiled, placed in the hot well, and thereby changes transfer characteristics. The relationship for updating each of the n coefficients in the filter is given by:

$$C_j(T+1)=C_j(T)+\beta ec(T)y(T-j+1)$$

In the foregoing, $C_j(T)$ is the coefficient for the jth filter tap at time T, $\beta$ is the filter adaption constant (a number between 0 and 1.00); ec(T) is the slicing error at time T; and $y(T-j+1)$ is the output of the jth stage of the transversal filter shift register which is the filter input y(T) delayed over time as the input Y(T) proceeds through stages to the jth stage.

In the foregoing, it will be seen that if $\beta$ is reduced to zero, no feedback occurs and no adjustment is made. On the other hand, if it is 1.000, then the error feedback creates excessive jitter in successive operations. Accordingly, a small ratio of feedback is helpful, something under 0.1 and the ideal is in the range of about 0.06. This can be adjusted to change the response in which coefficients are changed. Also, the input data word Y(T−j+1) is the filter input to the jth stage where j is the particular stage of the n stage storage line.

Figure 10:
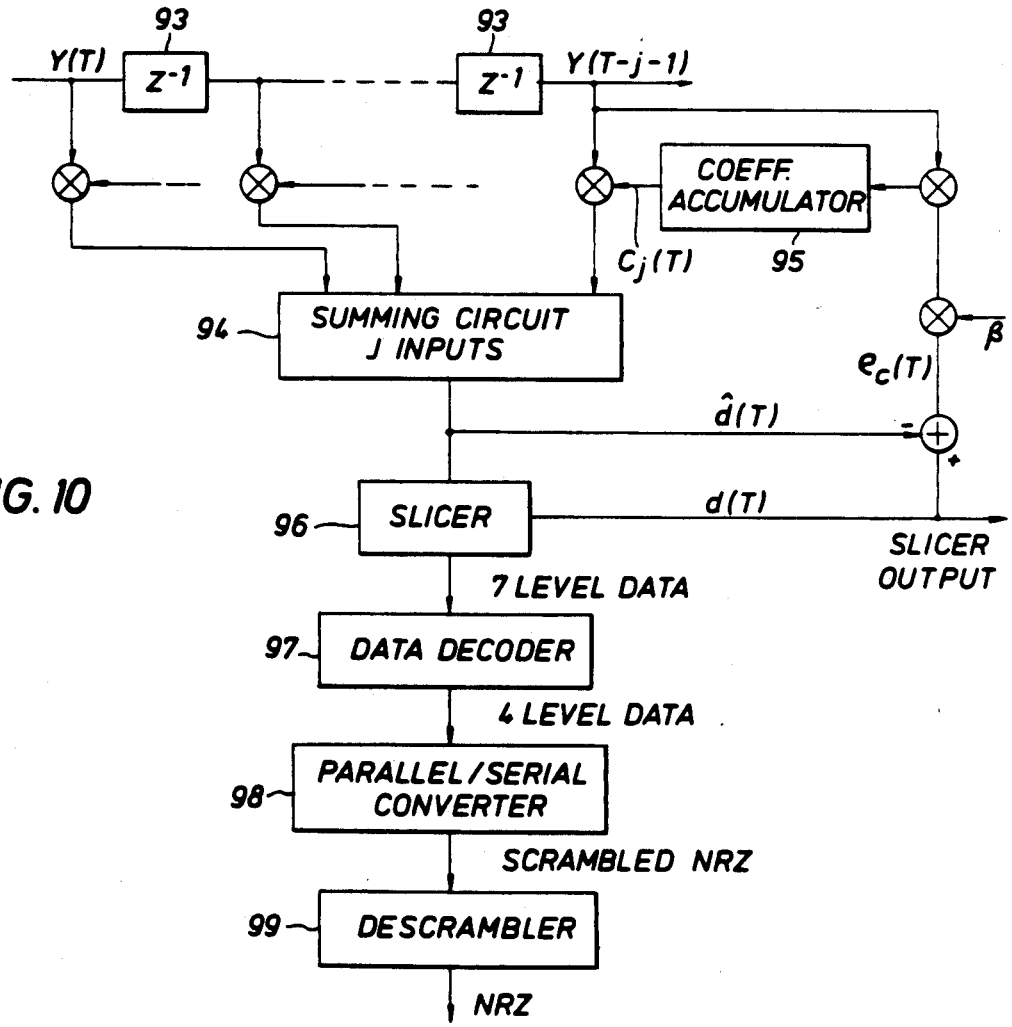
FIG. 10 is the surface located equalizer, slicer and data decoder.

In FIG. 10 of the drawings, the numeral 93 identifies the storage locations for consecutive digitized words. Each storage location 93 is serially connected with similar storage locations. Thus, the filter input is given by the symbol Y(T) which is the digitized word representing the distorted uplink digital signal from the cable. Each stage holds the serially arranged words for one unit of delay. The digitized words Y(T) are advanced from stage to stage. Thus, the latest entry is Y(T) and the prior entry is Y(T−1). The summed output representing a particular pulse amplitude is represented by the symbol (T). It is a summation of assigned coefficients $C_2 \ldots C_n$ multiplied times the n digital words in the delay line of FIG. 10. Thus, d(T) is equal to $[C_1 * Y(T-1)]+[C_2 * Y(T-1)] + \ldots C_n Y(T-m+1)$. This summation from the summing circuit 94 provides the value for pulse amplitude. Accordingly, the filter system shown in FIG. 10 forms the output d(T) which is delivered for subsequent processing.

FIG. 10 further includes means for updating each one of the coefficients. Recall that the system is implemented with n multiple stages and n multiple coefficients, the practical number being thirty-two coefficients for the thirty-two stages. Coefficient adjustment can be accomplished at all n stages. All the n stages receive coefficient adjustment which is accomplished in this manner. In an ideal situation, it is possible to adjust all thirty-two values of the coefficients after each addition. This is accomplished using the accumulator and adder circuitry shown in FIG. 8 input to the coefficient accumulator 96.

Consider one sequence of operations utilizing the filter of FIG. 10 which accomplishes equalization and slicing. Based on an understanding of the description herein and especially with FIG. 10, the steps of equalization and slicing are accomplished using the adaptive transversal filter equalizer of the present disclosure.

Assume that thirty-two taps are included in the filter. To obtain this, the data is input and processed through thirty-two storage locations in a ring. Thus, when the thirty-third word is input, the first word previously input into the storage ring is discarded. Thirty-two coefficients are likewise input for the thirty-two coefficient accumulators 95 which connect to the summation circuit 94. The summation circuit 94 forms the sum from the data words Y(T) input to the thirty-two storage cells. Since the stages are connected serially, the stages 93 function as a thirty-two step delay line. The current input again is Y(T) while the prior input was Y(T−1). A first coefficient at the time T−1 is registered in the accumulator 95. The summing circuit 94 forms a representation after summation which sum represents the filter output of the equalized uplink signal. This value assists in creating an error et or the difference between the predicted and summed data becomes the slicing error. Recall the previously given equation; in that, the slicing error is multiplied by the adaption coefficient or $\beta$ in the last term of that equation. It will be observed in FIG. 10 that $\beta$ is an input to the feedback path of the accumulator 95 so that the accumulator will increment to a new value for the coefficient. The new value of coefficient is calculated as an adjustment of the old value, and the new value is then available for the next calculation using the coefficient in the accumulator 95. It will be appreciated that, in routine repetitive operation, a new digital word is input to each of the stages 93 making up the ring storage circuit having thirty-two taps, and each coefficient is again recalculated in the same fashion as described above, namely by multiplication of the adaption coefficient or $\beta$. In this sense, all the accumulators 95 for the n coefficients are adjusted on each operation. It is optimum that all the n coefficients be updated each cycle which thereby controls the summation input to the summing circuit 94 which operates in such a fashion that the error is reduced. In other words, the slicing error is made smaller on each iteration. As a practical matter, some selected set of coefficients can be updated each cycle of operation such as one half or one fourth each cycle. Since the $\beta$ is so small, the incremental change is normally small and the coefficient can be changed periodically, perhaps every fourth cycle.

The net result is that each seven level symbol is equalized and then sliced by the slicer 96. Symbols are sequentially processed and therefore transmission error in one transmitted symbol may impact data up to thirty-two symbols earlier or later. The weighting of the several coefficients helps reduce error impact. This particularly aids in elimination of ringing and the like. It also helps prevent long term drift. Preferably, the $\beta$ term in the equation above is kept relatively small so that changes in the coefficients are implemented slowly. While such changes are important, overdriving by letting $\beta$ become too large creates a lack of stability.

In FIG. 10 of the drawings, the slicer thus provides the output which is brought to one of the slice levels as appropriate as represented in FIG. 4. Again, assume that the normalized data value is 3.00 units. Assume further that the distortion in transmission delivers a value of 3.12 units. The slicer 96 subtracts the 0.12 unit and provides an output which is 3.00 units in height. This corresponds to a slicer output of 3.00 which enables subsequent decoding, see FIG. 4. Likewise, the foregoing slicing procedure may be required to add to the value. Assume that the normalized AGC data output is 2.92 units. In that instance, the slicer has to add 0.08 units to arrive at 3.00 units. The slicer reconstructs the data in this fashion, providing conversion from values which might fall in between levels and converting that into the seven levels, see FIG. 4. The seven levels are then converted into the four levels. This is carried out in FIG. 10 of the drawings by the data decoder 97 which is connected with a parallel to serial converter 98. That provides an output which is scrambled NRZ, and a descrambler 99 converts that data back into the transmitted NRZ.

Figure 9:
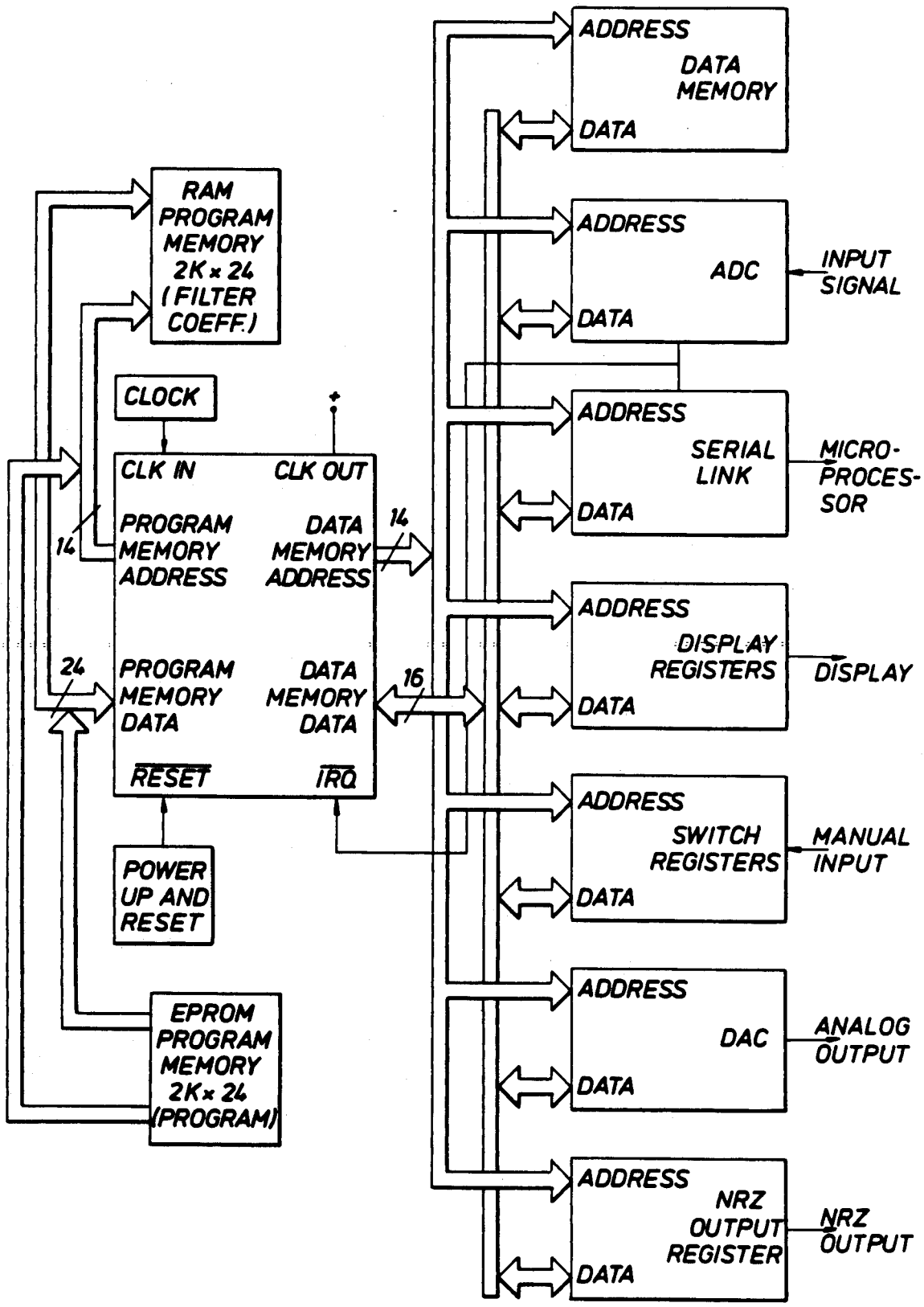
FIG. 9 is the surface located digital signal processor and registers for filter operation.

FIG. 9 of the drawings shows a block diagram of a digital signal processor for carrying out such conversions in the equalizer filter. Briefly, it is a system which includes appropriate busses and registers for operation in the foregoing fashion under appropriate instructions. Moreover, one version of this is a device known as the ADSP-2100. This is not the microprocessor 84 which controls operation of the uplink receiver; rather, FIG. 9 shows the filter process.

While the foregoing is directed to the preferred embodiment of the scope thereof is determined by the claims which follow:

What is claimed is:

1. A telemetry system for use in transfer of a data system from a sonde in a well borehole to the surface via an armored monocable having defined electrical characteristics of impedance, capacitance and inductance and the system includes a sonde supported uplink transmitter, comprising:

(a) a bus control unit in a sonde having an input data bus for receiving data from at least on tool supported inn the sonde wherein the tool data is required at the surface;

(b) means connected to said bus control unit for receiving a flow of data therefrom, said means encoding the data to form a duobinary encoded stream of data symbols wherein each data symbol represents an input data state and also correlates to another data state;

(c) modulator means forming a carrier signal, said means provided with said duobinary symbol to form an output data stream modulated on the carrier signal wherein the carrier signal has a specified carrier frequency, and further wherein the carrier signal is centered at a specified and width for subsequent transmission and further wherein each data symbol is encoded with a positive carrier peak value and each symbol is also encoded with a negative and adjacent carrier peak;

(d) output driver means provided with the modulated carrier signal and having an analog output connected to the monocable deployed as a logging cable extending from the sonde to the surface andd wherein the monocable has a specified band width within limits in part determined by the electrical characteristics of t he monocable in use; and (e) wherein said carrier frequency is centered in a band width determined by the characteristics of the monocable driven by the output means and further wherein the modulated duobinary signal placed thereon is frequency limited to fit within the band width.

2. The apparatus of claim 1 including means for timing operation of said bus control unit to deliver separated data streams interleaved from first and second tools in the sonde.

3. The apparatus of claim 1 including means for scrambling data input to said encoder means.

4. The apparatus of claim 1 including a digital to analog converter connected to the output of said modulator means wherein the output of said converter is then connected to filter means for limiting the harmonic content output and said filter means is input to said driver means.

5. The apparatus of claim 1 wherein said output means comprises line driver amplifier connected to an LC tank circuit loading said amplifier.

6. The apparatus of claim 1 including an input circuit for said bus control unit, said input circuit having multiple analog inputs connected with means for multiplexing the analog inputs thereto, and wherein said multiplexer is connected to an analog to digital converter providing an output to said bus control unit.

7. The apparatus of claim 1 wherein said monocable is connected to an uplink transmitter at said output means and additionally is connected to a downlink receiver in said sonde wherein said uplink transmitter and downlink receiver operate at mutually exclusive but adjacent frequency bands.

8. The apparatus of claim 7 further including a blocking capacitor permitting AC to pass along said monocable while blocking DC current flow wherein said blocking capacitor permits data too flow and from the sonde and blocks DC current to enable isolation of the data flow from the DC current.

9. A telemetry system for use in transfer of a data stream from a sonde in a well borehole to the surface via an armored monocable having defined characteristics of impedance, capacitance and inductance and the system includes a sonde supported uplink transmitter, comprising:

(a) a bus control unit in a sonde having an input data bus data bus for receiving data from at least one tool supported in the sonde wherein the tool data is required at the surface;

(b) means connected to said bus control unit for receiving a flow of data therefrom, said means encoding the data to form a duobinary encoded stream of data symbols wherein each data symbol represents an input data state and has up to seven levels;

(c) modulator means forming a carrier signal, said means provided with said duobinary symbols to form an output data stream modulated on the carrier signal wherein the carrier signal has a specified carrier frequency, and further wherein the carrier signal is centered at a specified band width for subsequent transmission;

(d) output driver means provided with the modulated carrier signal and having an output connected to a monocable deployed in a logging cable extending from the sonde to the surface deployed in a logging cable extending from the sonde to the surface and wherein the monocable has a specified band width determined in part by the electrical characteristics of the monocable in use; and (e) wherein said carrier frequency is centered in a band width determined by the characteristics of the monocable drive by the output means and further wherein the modulated duobinary signal placed thereon is frequency limited to fit within the band width.

10. The apparatus of claim 9 wherein said encoding means includes:

(a) first means for converting the data from said bus control unit into a fourth state digital signal; and (c) second means connected to said first means for converting the four state digital signals into a seven level duobinary signal.

11. The apparatus of claim 10 including third means connected to said second means for shifting the seven level signal to center the seven levels relative to a reference level.

12. The apparatus of claim 11 including low pass filter means limiting high frequency content of the shifted seven level signal.

13. In telemetry system for use in transfer of a data stream from at least one tool supported in a sonde wherein the sonde additionally incorporates an uplink transmitter for the telemetry system and the telemetry system is connected to the end of a monocable in a logging cable supporting the sonde in a well borehole, and the telemetry system includes a well head located uplink receiver, the receiver comprising:

(a) amplifier means connected to the monocable in a logging cable for receiving a telemetry signal from a sonde supported on the logging cable, said amplifier means forming an amplified carrier signal output modulated with sequential data symbols received from the monocable;

(b) demodulator means connected to said amplifier means for removing the carrier signal and providing an output of consecutive data symbols having the form of a series of digital words; and (c) fractionally spaced transversal filter means provided with the demodulated signal over a period of time wherein at least two sample values are obtained from each data symbol, and data symbols are serially formed by summation of a series of sample values in said filter means.

14. The apparatus of claim 13 including an input automatic gain control amplifier and further wherein said amplifier forms an AGC output signal including serially arranged data symbols subject to distortion during monocable transmission.

15. The apparatus of claim 13 further including a clock recovery circuit connected to receive the signal from the monocable, said clock recovery circuit forming a clock recovery pulse.

16. The apparatus of claim 15 wherein said amplifier means comprises an input AGC amplifier means for the signal provided by the monocable, analog to digital converter means connected to said AGC amplifier means for forming a procession of digital words therefrom, said demodulator means is connected to said amplifier means for removing modulating carrier signal, and wherein said demodulator means is connected to said filter means.

17. The apparatus of claim 15 wherein said filter means connects with a slicing circuit converting the output data symbols from said filter means into acceptable digital levels.

18. A method of encoding data for transmission along a well logging cable supporting a sonde in a well borehole wherein the data is transmitted from a tool forming the data through a transmitter in the sonde and the transmitter incorporates telemetry means, and the logging cable extends to the surface where it connects with a receiver including cooperative and responsive telemetry means and the data transfer along a monocable between the sonde and the surface located equipment distorts the data, the method comprising:

(a) forming a data stream resulting from conducting logging operations with the sonde in a well borehole wherein the data stream includes consecutive duobinary data symbols, and the data symbols are encoded thereby are subsequently modulated onto a carrier having a frequency centered within a selected bandwidth for the monocable;

(b) transmitting the data stream along the monocable to the surface;

(c) amplifying the received data stream to a specified level at the surface;

(d) sequentially sampling consecutive data symbols to obtain at the surface at least two samples for each data symbol;

(e) from a series of sequential samples, forming a summation to represent a transmitted data symbol and thereafter forming a next transmitted data symbol; and (f) wherein serially arranged data symbols are representative of logging operations in the well borehole.

19. The method of claim 18 including:

(a) the step of forming sequential samples as digital words and storing a series of such digital words;

(b) modulating a carrier clock signal having two states with the data stream for monocable telemetry;

(c) wherein the step of forming sequential samples forms two samples per data symbol with on of the samples coinciding with one of the two clock signal states, and the second coinciding with the other of the two clock signal states;

(d) demodulating the sequential samples to remove the carrier; and (e) after forming the representations of the transmitted data symbols, then slicing such representations to obtain acceptable digital levels.

20. The apparatus of claim 19 including means for decoding responsive to the encoded symbols in adjacent data symbols.

21. A method of telemetry transfer from a sonde in a well borehole via a cable having defined electrical characteristics of impedance, inductance and capacitance to the surface of a well comprising the steps of:

(a)) in a sonde, making a measurement of a selected parameter wherein the measured parameter data is formatted as a series of discrete voltage level changes occurring at a specified rate;

(b) applying the series of discrete voltage level changes to a conductor in a logging cable extending from the sonde to the surface of the well borehole;

(c) at the surface, measuring the amplitude of each of said voltage levels on the logging cable N times where N is a positive whole number integer;

(d) from the N voltage amplitude measurements at the surface, constructing a voltage level representing a reconstructed voltage level sent up the logging cable wherein said reconstructed voltage level is subjected to variation as a result of signal transmission along the cable subject to cable electrical characteristic variations;

(e) adjusting the amplitude of said reconstructed measurement to one of a series of discrete permitted levels by adding to or subtracting from said reconstructed level to thereby form a series of discrete voltage level changes having the same format as the formatted series of discrete voltage level changes in the sonde; and (f) decoding the sonde measurements from the formatted discrete voltage level changes to form an output signal representative of the sonde measurement.

22. The method of claim 21 wherein a carrier signal is formed in the sonde and is modulated with the series of voltage level changes so that each voltage level of the series forms a carrier positive voltage peak and negative voltage peak encoding that voltage level change, and a carrier signal is applied to the conductor to transfer the series of voltage level changes along the conductor to the surface of the well borehole.

23. The method of claim 21 wherein the step of measuring the amplitude of each of the voltage level changes involves a first measurement and a subsequent and second measurement and said first and second measurements provided the amplitude of the voltage level received at the surface.

24. The method of claim 23 wherein an average is obtained of the absolute values of the measured voltage amplitudes for the N voltage level measurements, and then the step of adjusting either adds to or subtracts from the average voltage amplitude so obtained, and a specific voltage level value in said series of discrete voltage levels thereby while values not meeting that specific voltage level value are thus adjusted by the process of adding to or subtracting from said average voltage level to adjust it to the nearest of said formatted series of discrete voltage levels.

* * * * *